US010801143B2

(12) United States Patent
Tseng

(10) Patent No.: US 10,801,143 B2
(45) Date of Patent: Oct. 13, 2020

(54) KNEE OPERATED LIFTING MECHANISM FOR A PRESSER FOOT OF A SEWING MACHINE

(71) Applicant: Hsien-Chang Tseng, Taichung (TW)

(72) Inventor: Hsien-Chang Tseng, Taichung (TW)

( * ) Notice: Subject to any disclaimer, the term of this patent is extended or adjusted under 35 U.S.C. 154(b) by 468 days.

(21) Appl. No.: 15/828,808

(22) Filed: Dec. 1, 2017

(65) Prior Publication Data

US 2019/0169772 A1 Jun. 6, 2019

(51) Int. Cl.
*D05B 29/02* (2006.01)
*D05B 29/12* (2006.01)

(52) U.S. Cl.
CPC ..... *D05B 29/02* (2013.01); *D05B 29/12* (2013.01)

(58) Field of Classification Search
CPC ..... D05B 29/02; D05B 9/12
USPC ..... 112/237–239
See application file for complete search history.

(56) References Cited

U.S. PATENT DOCUMENTS 2,529,442 A * 11/1950 Andres ..... D05B 29/00 112/237
3,340,836 A * 9/1967 Goebel ..... D05B 75/02 112/237
4,409,914 A * 10/1983 Sansone ..... D05B 29/02 112/237
4,567,838 A * 2/1986 Vogel ..... D05B 27/24 112/237
5,220,877 A * 6/1993 Redovian ..... D05B 29/02 112/237
2014/0373765 A1* 12/2014 Tseng ..... D05B 29/02 112/237
2015/0233033 A1* 8/2015 Sakuma ..... D05B 29/02 112/237

* cited by examiner

*Primary Examiner* — Nathan E Durham
(74) *Attorney, Agent, or Firm* — Wang Law Firm, Inc.

(57) ABSTRACT

A knee operated lifting mechanism for a presser foot of a sewing machine is fixed on a body of the sewing machine, the body is provided with a presser-foot shaft, the knee operated lifting mechanism is drivingly connected to the presser-foot shaft, so as to consequently drive the presser foot to move up and down. The knee operated lifting mechanism includes a knee pushing device, a cable and a rotary member. The knee pushing device includes a knee pushing plate to be operated by a user. The cable is drivingly connected to the knee pushing plate to control the rotation of a drive shaft and the rotation of the presser-foot shaft as well, which consequently controls the upward and downward motion of the presser foot, and thus considerably simplifying the structure of the knee operated lifting mechanism.

20 Claims, 14 Drawing Sheets

KNEE OPERATED LIFTING MECHANISM FOR A PRESSER FOOT OF A SEWING MACHINE

BACKGROUND OF THE INVENTION

Field of the Invention

The present invention relates to a lifting mechanism for a fabric presser foot of a sewing machine, and more particularly to a knee operated lifting mechanism for a presser foot of a sewing machine.

Related Prior Art

Sewing machines are normally provided with a knee operated lifting mechanism or a hand-operated lifting mechanism to control the upward and downward motion of the presser foot. The knee operated lifting mechanism is usually driven by a set of connecting rods, which complicates the structure.

The present invention has arisen to mitigate and/or obviate the afore-described disadvantages.

SUMMARY

One objective of the present invention is to provide a knee operated lifting mechanism for a presser foot of a sewing machine which is capable of providing another transmission mode.

Another objective of the present invention is to a knee operated lifting mechanism for a presser foot of a sewing machine with a simplified structure.

To achieve the above objectives, a knee operated lifting mechanism for a presser foot of a sewing machine is fixed on a body of the sewing machine, the body is provided with a presser-foot shaft, the knee operated lifting mechanism is drivingly connected to the presser-foot shaft, so as to consequently drive the presser foot to move up and down, the knee operated lifting mechanism comprises:

a knee pushing device including a knee pushing plate to be operated by a user;

a cable drivingly connected to the knee pushing plate;

a rotary member pivotally mounted on the body of the sewing machine and including a cable fixing portion and a slide slot, wherein the cable is fixed to the cable fixing portion; and a drive shaft with one end inserted in the slide slot and another end drivingly connected to the presser-foot shaft;

pushing the knee pushing plate controls the cable to pull the rotary member to rotate, then the drive shaft drives the presser-foot shaft to rotate, consequently, the presser foot is driven to move upward, and when the rotary member rotates back to its original position, the drive shaft drives the presser-foot shaft to rotate back to original position, and thus the presser foot is pushed downward.

Preferably, the knee operated lifting mechanism includes a presser foot lifted up state in which the presser foot is lifted up and a presser foot pushed down state in which the presser foot is pushed down, the drive shaft extends in a height direction, the slide slot includes a first terminal edge and a second terminal edge, when in the presser foot lifted up state, the first terminal edge pushes the one end of the drive shaft to move downwards, and when in the presser foot pushed down state, the second terminal edge pushes the one end of the drive shaft to move upwards.

Preferably, the rotary member further includes an idle slot with one end connected to the first terminal edge, and the one end of the drive shaft is able to slide within the slide slot and the idle slot.

Preferably, a fixing member and a third elastic member, the fixing member is fixed to the body, and includes a lateral surface and a fixing portion, the rotary member is pivotally connected to the fixing member, the third elastic member has one end hooked to the fixing portion and another end to the drive shaft, so that the drive shaft is abutted against the lateral surface of the fixing member.

Preferably, the rotary member includes an elastic member fixing portion, and a second elastic member has one end hooked to the elastic member fixing portion and another end fixed to the body.

Preferably, the knee pushing device includes a rod with one end fixed to the knee pushing plate;

a first cable drive mechanism includes a main body and a linkage piece, the main body includes: two lateral walls and a main wall connected between the two lateral walls, the main wall includes a hole, the linkage piece includes a first section, a second section and a third section which are connected in sequence to one another, the first section is connected to another end of the rod, the first section is located at one side of the main body and is pivotally connected to the main body, so that, when the rod rotates, the first section is driven to rotate with respect to the main body, the second section is inserted in the hole, the third section is located at another side of the main body, and includes a cable locking portion for fixing the cable.

Preferably, the hole is formed by a main hole and a restricting hole, the restricting hole is provided with a restricting wall, one of the lateral walls includes an extension portion, the second section includes a restricting surface facing toward the restricting wall, and the third section includes a hooking portion;

a first elastic member has one end fixed to the extension portion and another end fixed to the hooking portion, with an elastic force of the first elastic member, the third section is maintained in an inclined upward position to make the restricting surface abut against the restricting wall.

Preferably, a lifting device includes a pivoting member inserted on the presser-foot shaft, and a lifting member, the presser-foot shaft is inserted in and drives the pivoting member to rotate, the pivoting member includes a pivot hole for insertion of the presser-foot shaft, a first abutting surface and a second abutting surface, a distance from a center of the pivot hole to the first abutting surface is defined as a first distance, a distance from the center of the pivot hole to the second abutting surface is defined as a second distance, the first distance is larger than the second distance, so as to allow the presser foot to move upward, the lifting member includes an abutting portion and a drive portion connected to the abutting portion, the drive portion drives the presser foot to move, when the presser foot moves upward, the abutting portion is abutted against the first abutting surface;

by such arrangements, the presser-foot shaft rotates the pivoting member to make the first abutting surface press against the abutting portion, and then the lifting member is caused to push the presser foot to move upward.

Preferably, the lifting device includes a positioning member, the pivoting member is located between the positioning member and the lifting member, the positioning member includes a restricting slot;

the drive portion includes a first positioning hole and a second positioning hole, the presser-foot shaft is inserted in the first positioning hole;

a fourth elastic member has one end fixed to the positioning member and another end fixed to the lifting member, so as to provide a force for pushing the abutting portion of the lifting member towards the first abutting surface or the second abutting surface;

a cloth presser includes a presser rod, a positioning rod and an elastic member, the presser rod is inserted in the body, the positioning rod has a first end fixed to the presser rod, the elastic member is sleeved onto the presser rod and has one end pressed against the positioning rod, a second end of the positioning rod is inserted in and movable along the restricting slot, the positioning rod includes a positioning pin inserted in the second positioning hole and abutted against one end of the second positioning hole, and the presser rod has one end provided for mounting of the presser foot.

A knee operated lifting mechanism for a presser foot of a sewing machine is fixed on a body of the sewing machine, the body is provided with a presser-foot shaft, the knee operated lifting mechanism is drivingly connected to the presser-foot shaft, so as to consequently drive the presser foot to move up and down, the knee operated lifting mechanism comprises:

a knee pushing device including a knee pushing plate to be operated by a user;

a cable drivingly connected to the knee pushing plate and the presser-foot shaft;

a lifting device includes a pivoting member inserted on the presser-foot shaft, and a lifting member, the presser-foot shaft is inserted in and drives the pivoting member to rotate, the pivoting member includes a pivot hole for insertion of the presser-foot shaft, a first abutting surface and a second abutting surface, a distance from a center of the pivot hole to the first abutting surface is defined as a first distance, a distance from the center of the pivot hole to the second abutting surface is defined as a second distance, the first distance is larger than the second distance, so as to allow the presser foot to move upward, the lifting member includes an abutting portion and a drive portion connected to the abutting portion, the drive portion drives the presser foot to move, when the presser foot moves upward, the abutting portion is abutted against the first abutting surface;

by such arrangements, pushing the knee pushing plate controls the cable to pull the presser-foot shaft and the pivoting member to rotate to make the first abutting surface press against the abutting portion, and then the lifting member is caused to push the presser foot to move upward.

By such arrangements, the knee operated lifting mechanism for the presser foot of the invention is capable of pulling the cable by pushing the knee pushing plate, then the cable pulls the rotary member to rotate. Meanwhile, the drive shaft is pushed to move upward or downward to drive the presser-foot shaft to rotate by different angles, which consequently causes the presser to move upward or downward. Motion is transmitted through the cable during the motion transmission process, which makes the invention easier to assemble and simplifies the structure of the invention.

Besides, in another embodiment, the knee operated lifting mechanism for the presser foot of the invention employs the knee pushing plate to drive the presser-foot shaft to rotate by different angles, and then the pivoting member is driven to rotate to make the first abutting surface or the second abutting surface stops against the lifting member, so that the lifting member is lifted up or lowered down to cause the presser rod on which the presser is mounted to move upward or downward, thus simplifying the structure of the invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

Figure 1:
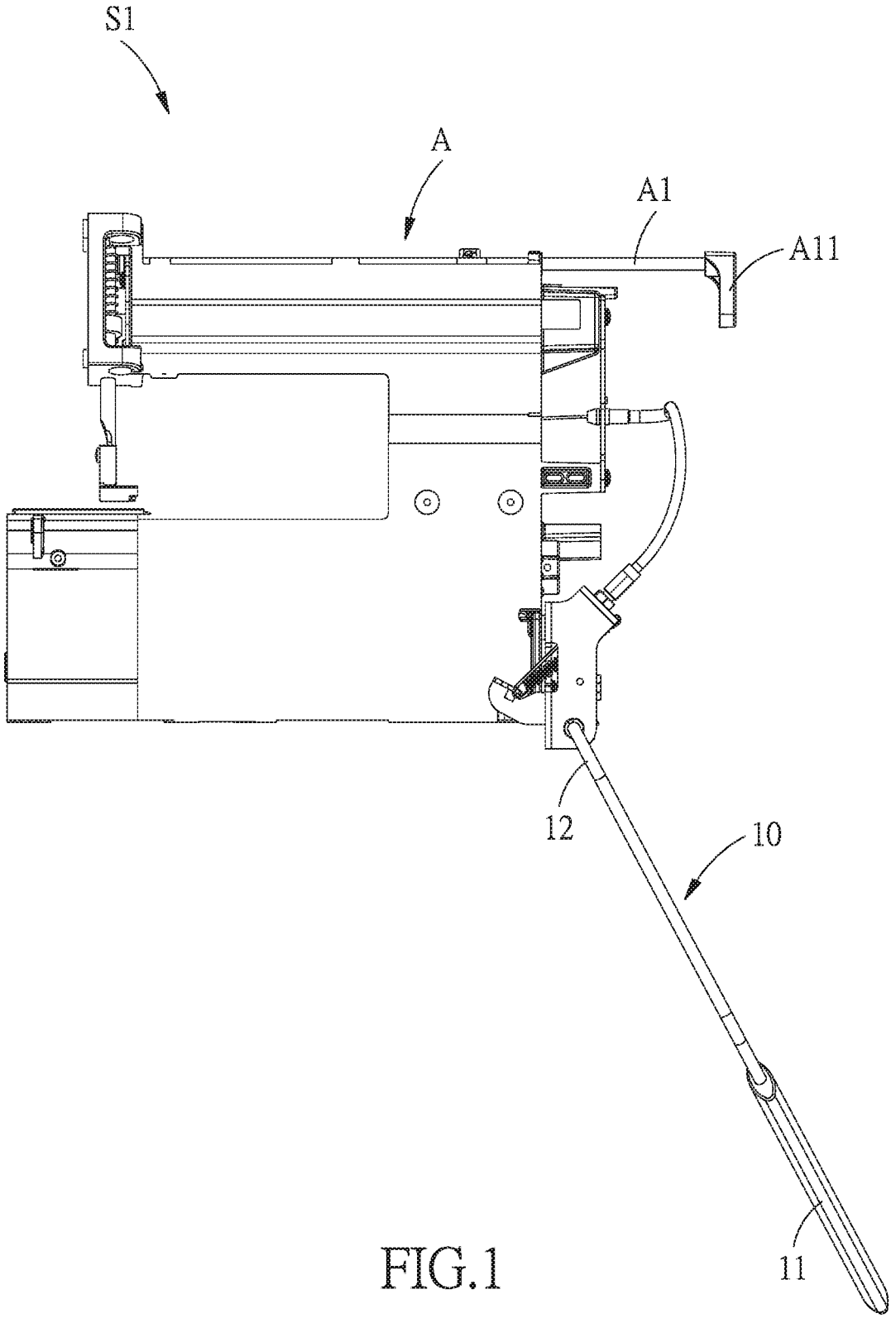
FIG. 1 is an illustrative view showing the lifted up state of a knee operated lifting mechanism for a presser foot of a sewing machine in accordance with the present invention.
Figure 2:
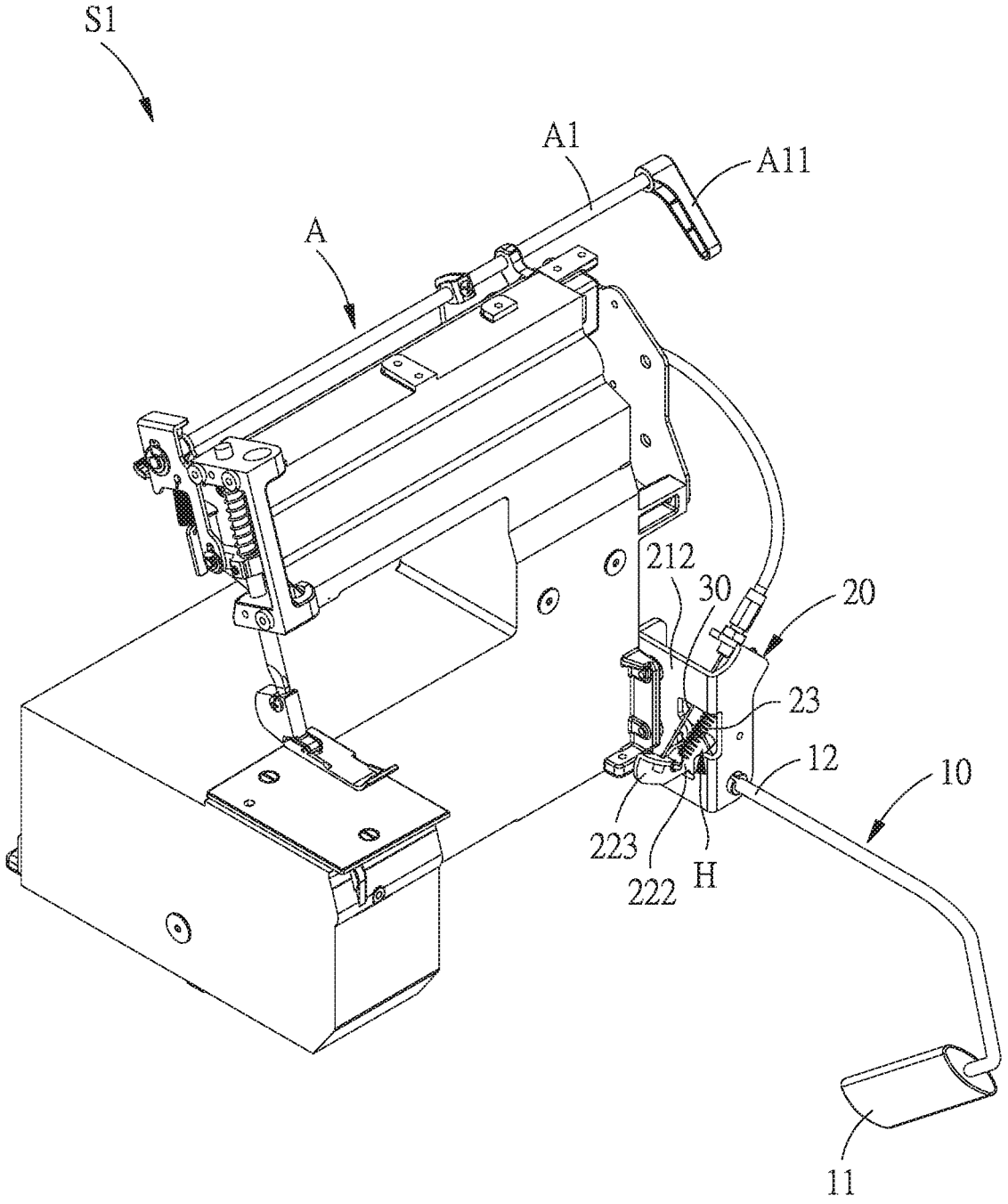
FIG. 2 is an illustrative view showing the pushed down state of the knee operated lifting mechanism for a presser foot of a sewing machine in accordance with the present invention.
Figure 3:
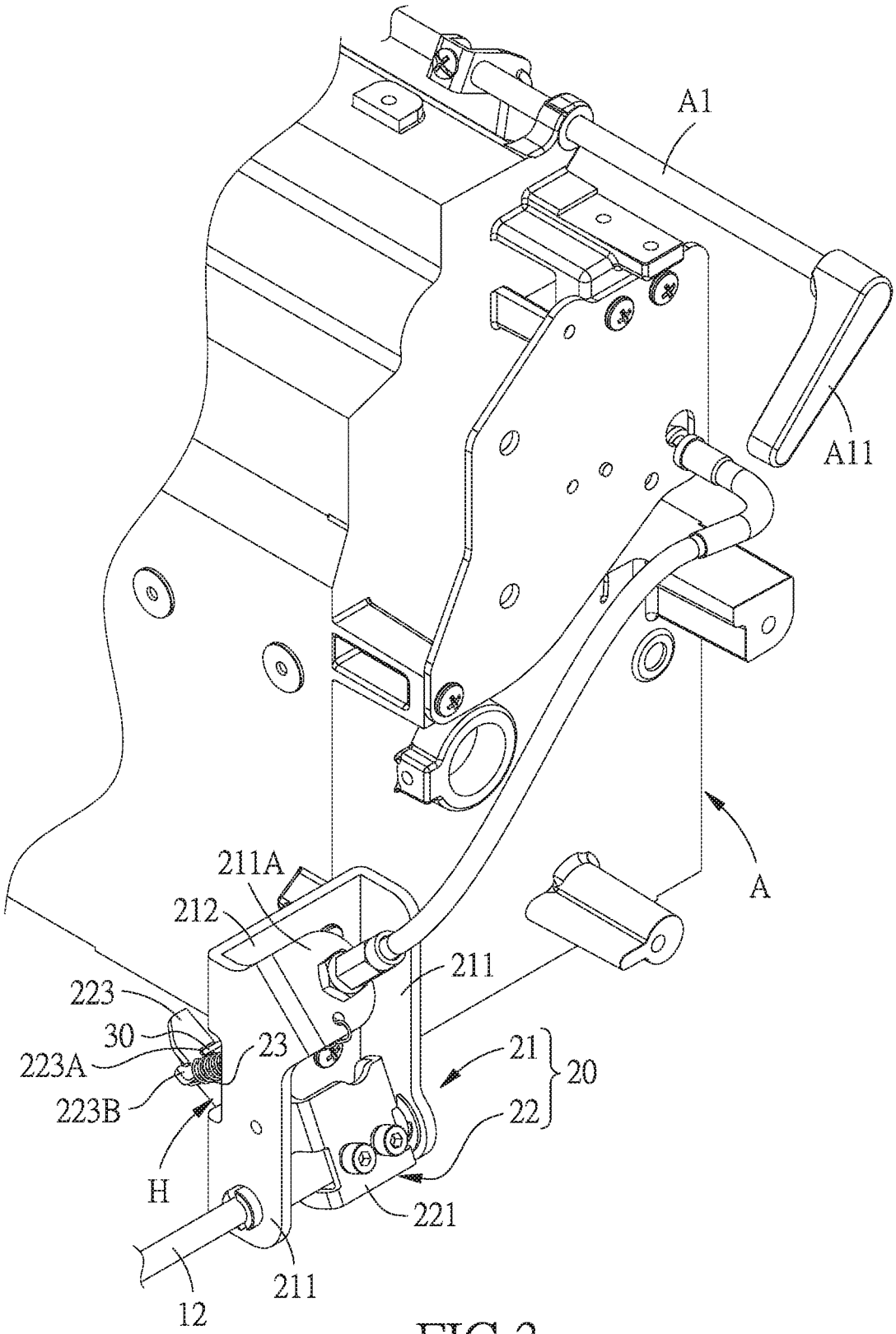
FIG. 3 is an illustrative view of a part of the knee operated lifting mechanism for a presser foot of a sewing machine in accordance with the present invention.
Figure 4:
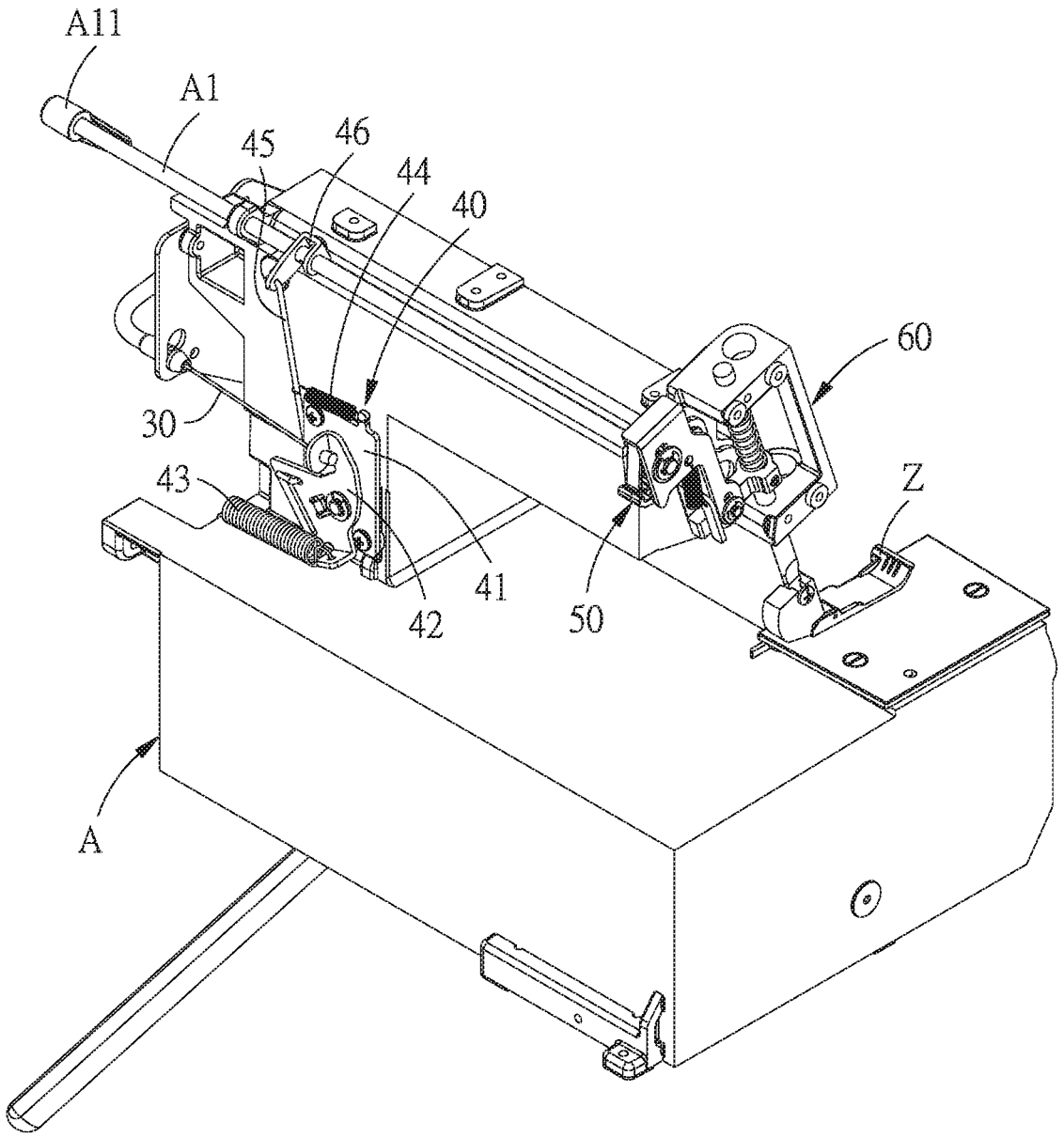
FIG. 4 shows the lifted up state of the knee operated lifting mechanism for a presser foot of a sewing machine in accordance with the present invention.
Figure 5:
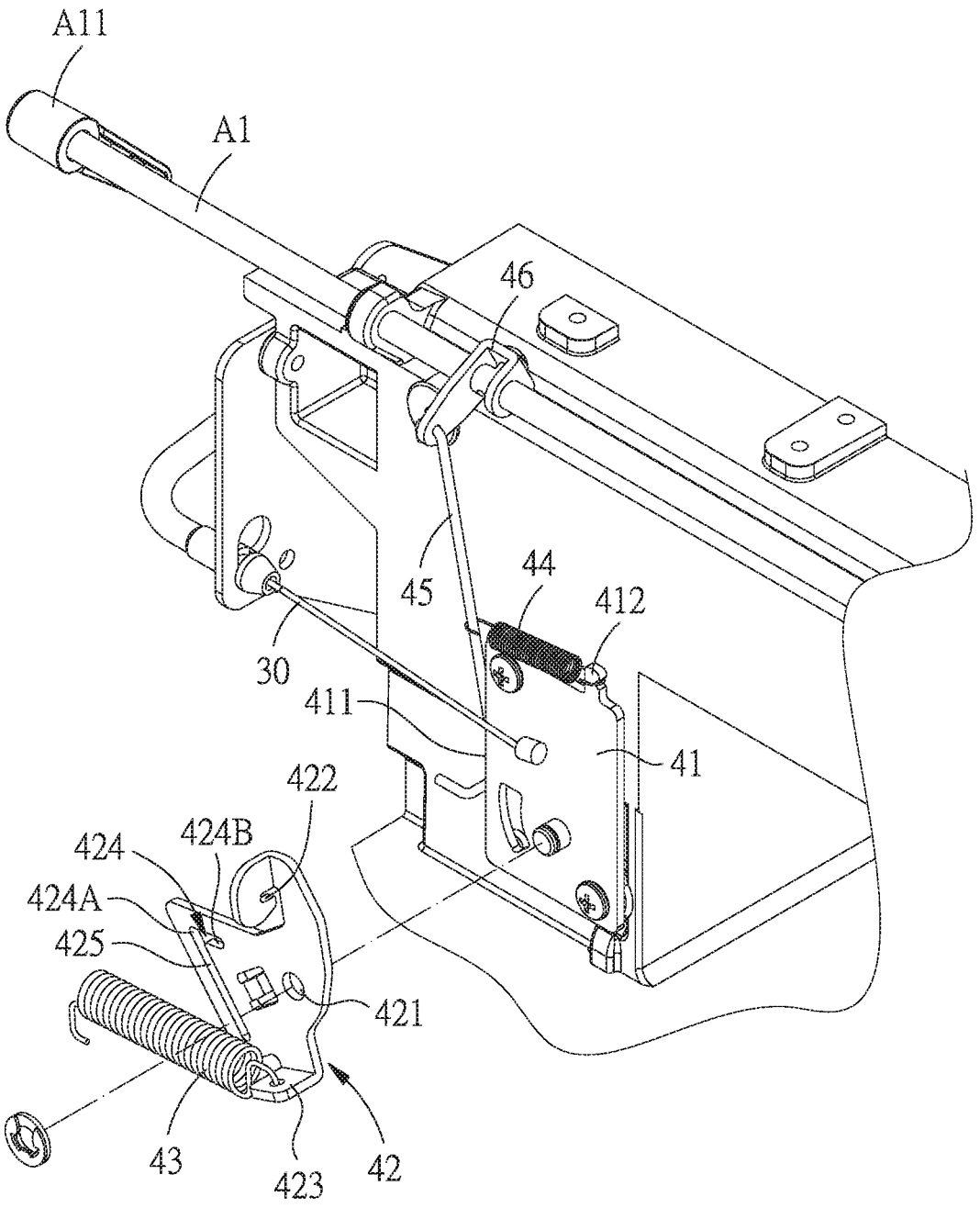
FIG. 5 is an exploded view of a part of the knee operated lifting mechanism for a presser foot of a sewing machine in accordance with the present invention.
Figure 6:
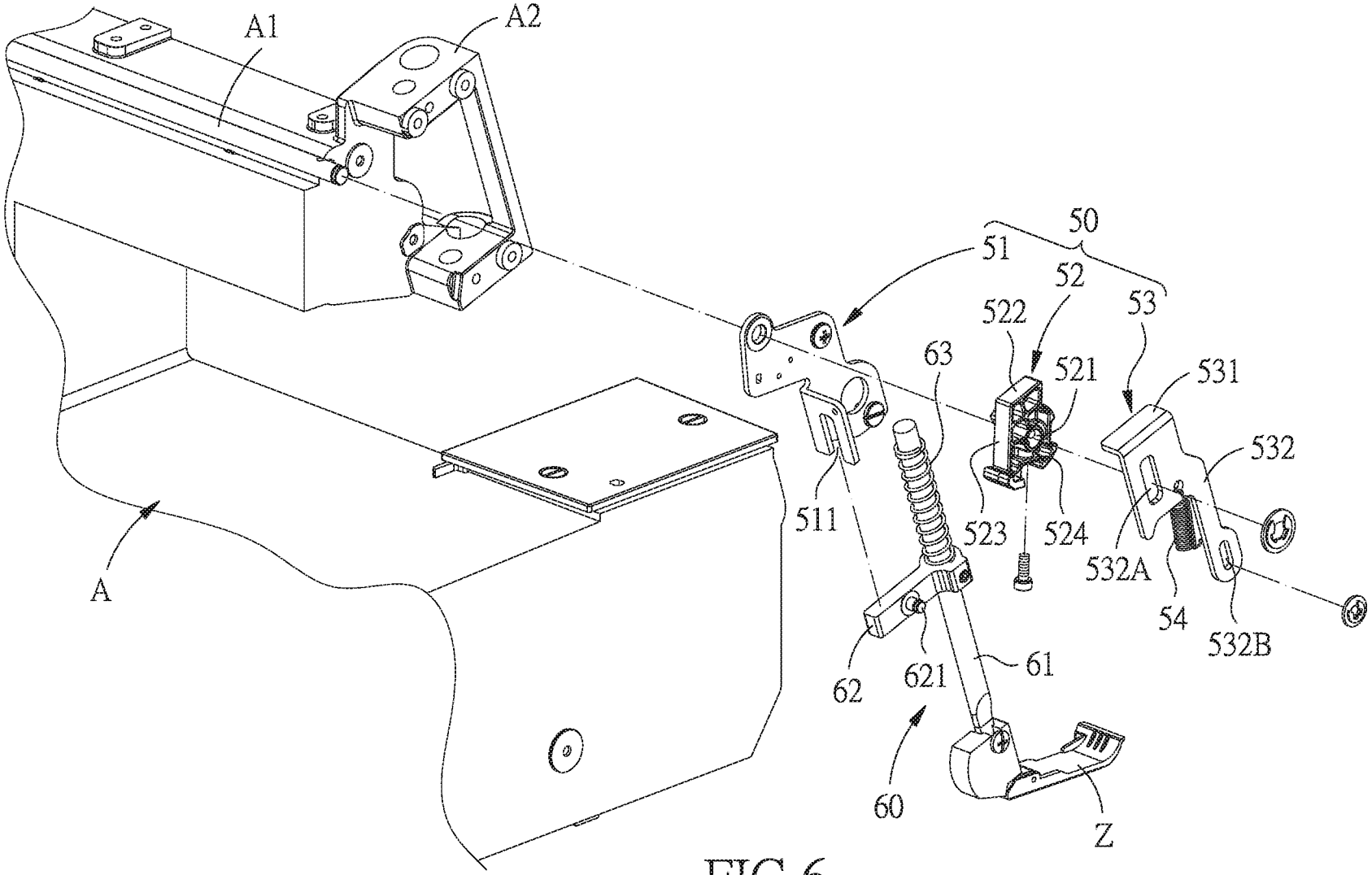
FIG. 6 is an exploded view of a part of the knee operated lifting mechanism for a presser foot of a sewing machine in accordance with the present invention.

The present invention will be clearer from the following description when viewed together with the accompanying drawings, which show, for purpose of illustrations only, the preferred embodiment in accordance with the present invention.

A knee operated lifting mechanism for a presser foot Z of a sewing machine in accordance with the present invention is fixed on a body A of the sewing machine, the body A is provided with a presser-foot shaft A1, as shown in FIGS. 1-14, the knee operated lifting mechanism is drivingly connected to the presser-foot shaft A1, so as to consequently drive the presser foot Z to move up and down. The knee operated lifting mechanism includes a presser foot lifted up state 51 in which the presser foot is lifted up and a presser foot pushed down state S2 in which the presser foot is pushed down. The knee operated lifting mechanism includes a knee pushing device 10, a first cable drive mechanism 20, a cable 30, a second cable drive mechanism 40, a lifting device 50 and a cloth presser 60.

The knee pushing device 10 includes a knee pushing plate 11 and a rod 12 with one end fixed to the knee pushing plate 11.

Figure 11:
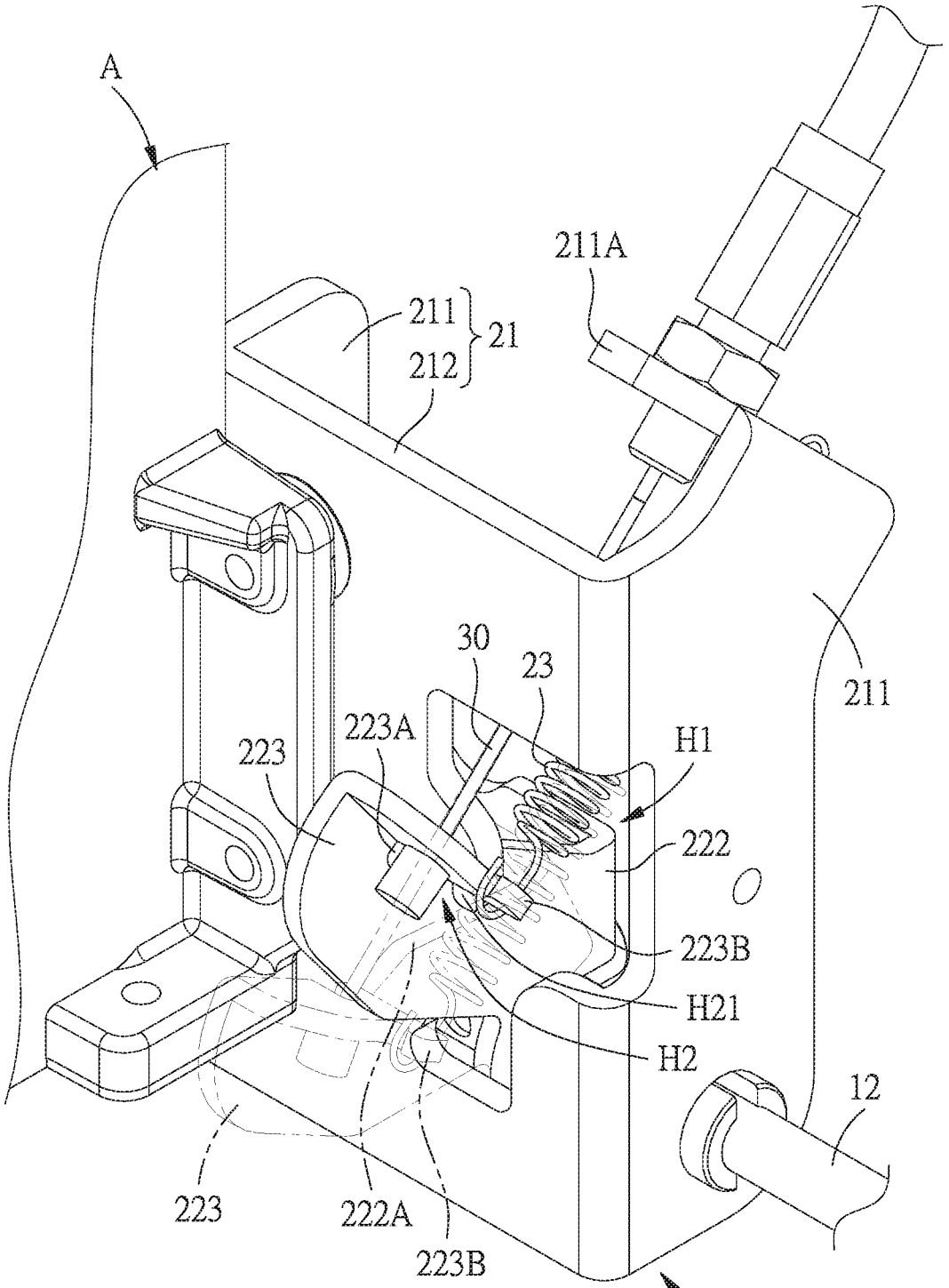
FIG. 11 is another illustrative view showing the pushed down state of the knee operated lifting mechanism for a presser foot of a sewing machine in accordance with the present invention.
Figure 12:
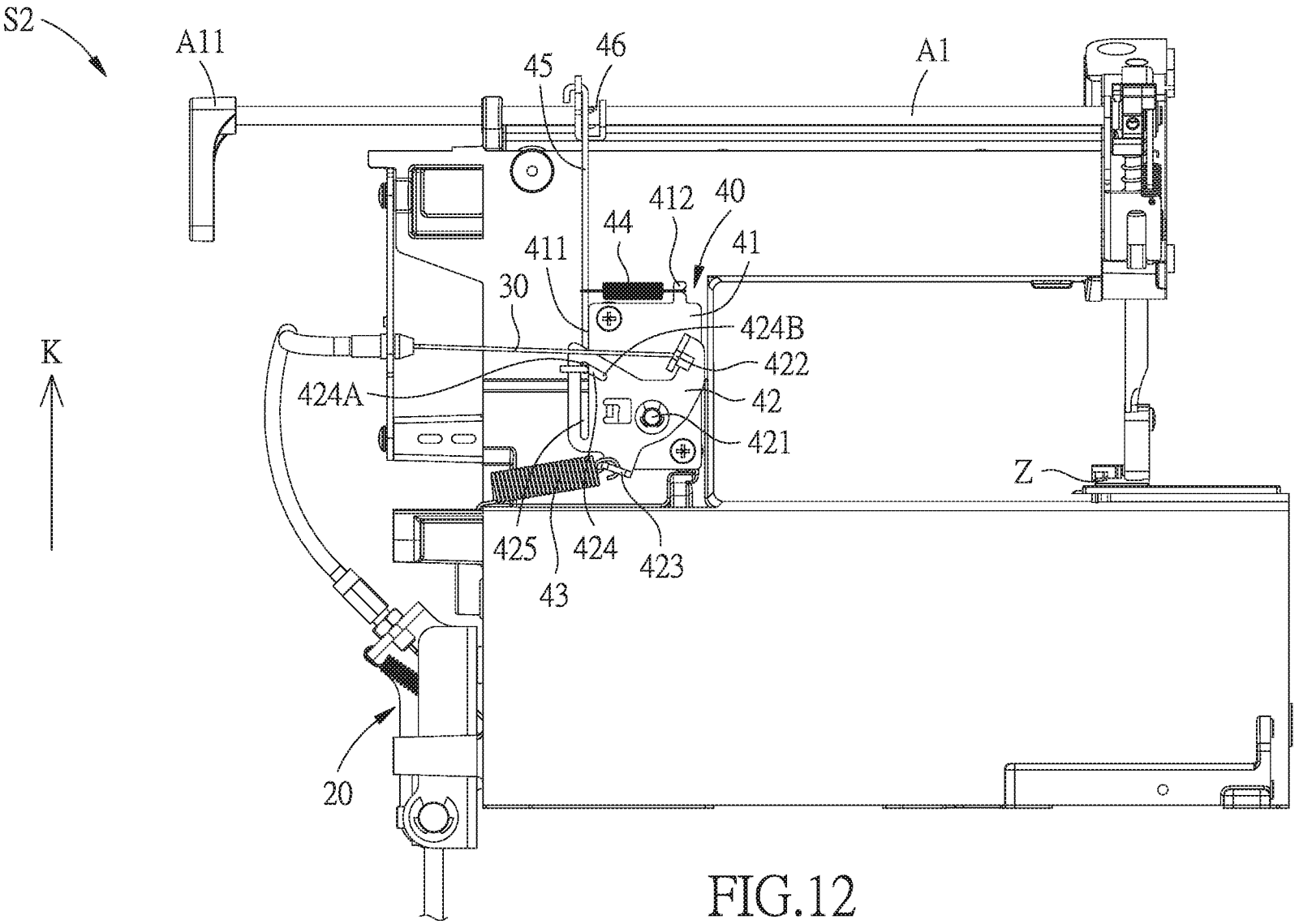
FIG. 12 is another illustrative view showing the pushed down state of the knee operated lifting mechanism for a presser foot of a sewing machine in accordance with the present invention.
Figure 13:
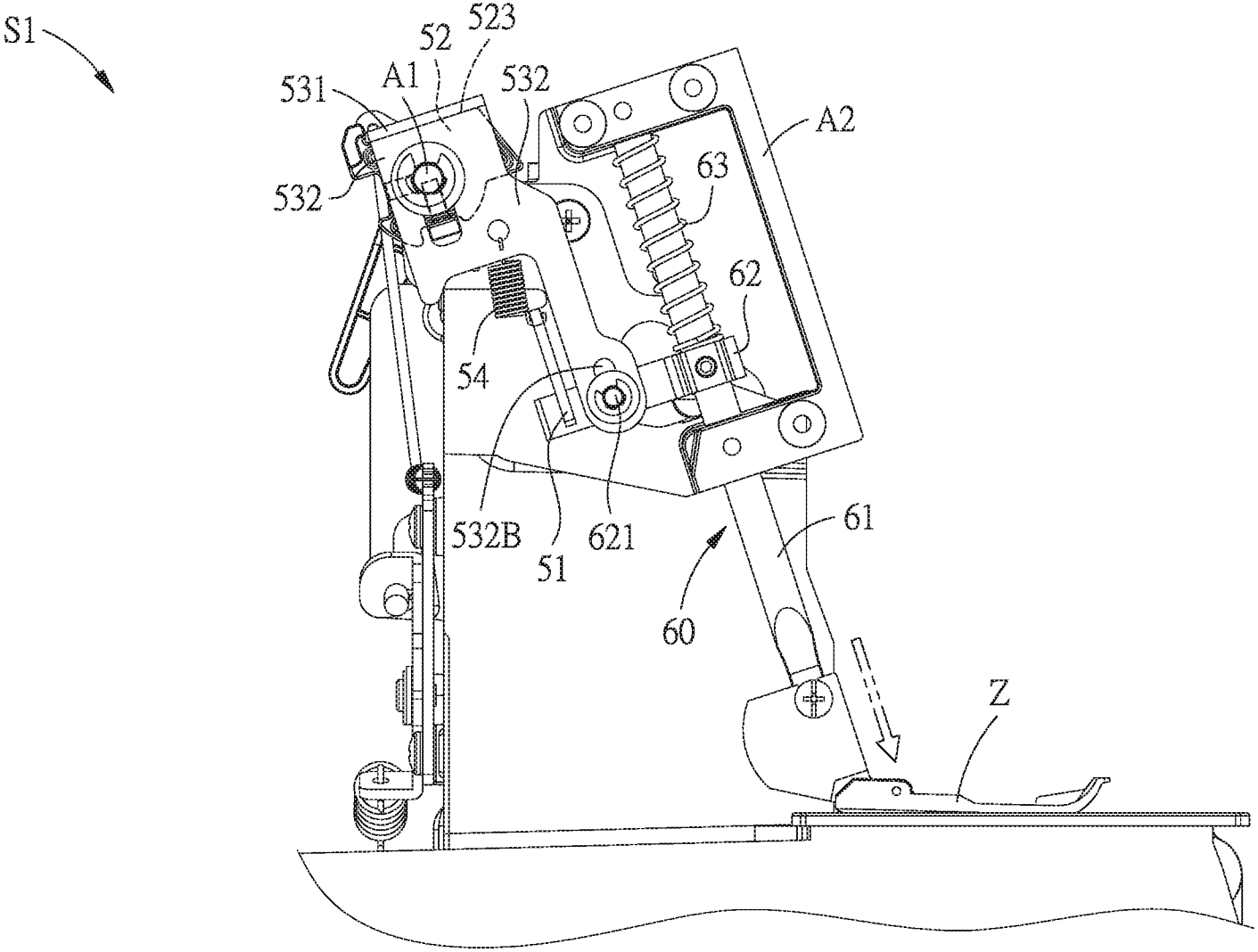
FIG. 13 is another illustrative view showing the pushed down state of the knee operated lifting mechanism for a presser foot of a sewing machine in accordance with the present invention.

The first cable drive mechanism 20 includes a main body 21, a linkage piece 22 and a first elastic member 23. The main body 21 is connected to the body A and includes: two lateral walls 211 and a main wall 212 connected between the two lateral walls 211. The two lateral walls 211 extend in a direction perpendicular to the main wall 212 which includes a hole H. One of the lateral walls 211 includes an extension portion 211A extending in the same direction as the main wall 212. In a preferred embodiment, the hole H is formed by a main hole H1 and a restricting hole H2. The restricting hole H2 is provided with a restricting wall H21 (as shown in FIG. 11). The linkage piece 22 includes a first section 221, a second section 222 and a third section 223 which are connected in sequence to one another. The first section 221 is connected to another end of the rod 12. The first section 221 is located at one side of the main body 21 and is pivotally connected to the main body 21, so that, when the rod 12 rotates, the first section 221 can be driven to rotate with respect to the main body 21. The second section 222 is inserted in the hole H and includes a restricting surface 222A facing toward the restricting wall H21. The third section 223 is located at another side of the main body 21, and includes a cable locking portion 223A and a hooking portion 223B. The first elastic member 23 has one end fixed to the extension portion 211A and another end fixed to the hooking portion 223B. With the elastic force of the first elastic member 23, the third section 223 is maintained in an inclined upward position to make the restricting surface 222A abut against the restricting wall H21.

The cable 30 has one end fixed to the cable locking portion 223A.

The second cable drive mechanism 40 includes a fixing member 41, a rotary member 42, a second elastic member 43, a third elastic member 44, a drive shaft 45 and a hanging portion 46. The fixing member 41 is fixed to the body A, and includes a lateral surface 411 and a fixing portion 412. The rotary member 42 includes a pivot point 421. In this embodiment, the rotary member 42 is pivotally connected to the fixing member 41 by a pivot, and the pivot point 421 is a through hole through which is the pivot is inserted. The rotary member 42 includes a cable fixing portion 422, an elastic member fixing portion 423 and a slide slot 424 with an elongated shape. The cable fixing portion 422 and the elastic member fixing portion 423 are located at two sides of the pivot point 421. The cable 30 has another end fixed to the cable fixing portion 422. The second elastic member 43 has one end hooked to the elastic member fixing portion 423 and another end fixed to the body A, so that the rotary member 42 can keep the presser foot in the presser foot pushed down state S2. The drive shaft 45 extends in a height direction K, and has one end movably inserted in the slide slot 424. The third elastic member 44 has one end hooked to the fixing portion 412 and another end to the drive shaft 45, so that the drive shaft 45 can be abutted against the lateral surface 411 of the fixing member 41. The slide slot 424 includes a first terminal edge 424A and a second terminal edge 424B. In this embodiment, the first terminal edge 424A and the second terminal edge 424B are located at the same height in the height direction K when in the presser foot lifted up state S1, and when in the presser foot pushed down state S2, the first terminal edge 424A is higher than the second terminal edge 424B in the height direction K. In a preferred embodiment, the rotary member 42 further includes an idle slot 425 with one end connected to the first terminal edge 424A. The idle slot 425 has an elongated shape and defines an angle with respect to the slide slot 424. When in the presser foot pushed down state S2, the idle slot 425 extends in the height direction K, and when in the presser foot lifted up state S1, the idle slot 425 extends in a direction at an angle with respect to the height direction K. The hanging portion 46 is fixed to the presser-foot shaft A1, and the drive shaft 45 has another end fixed to the hanging portion 46.

Figure 9:
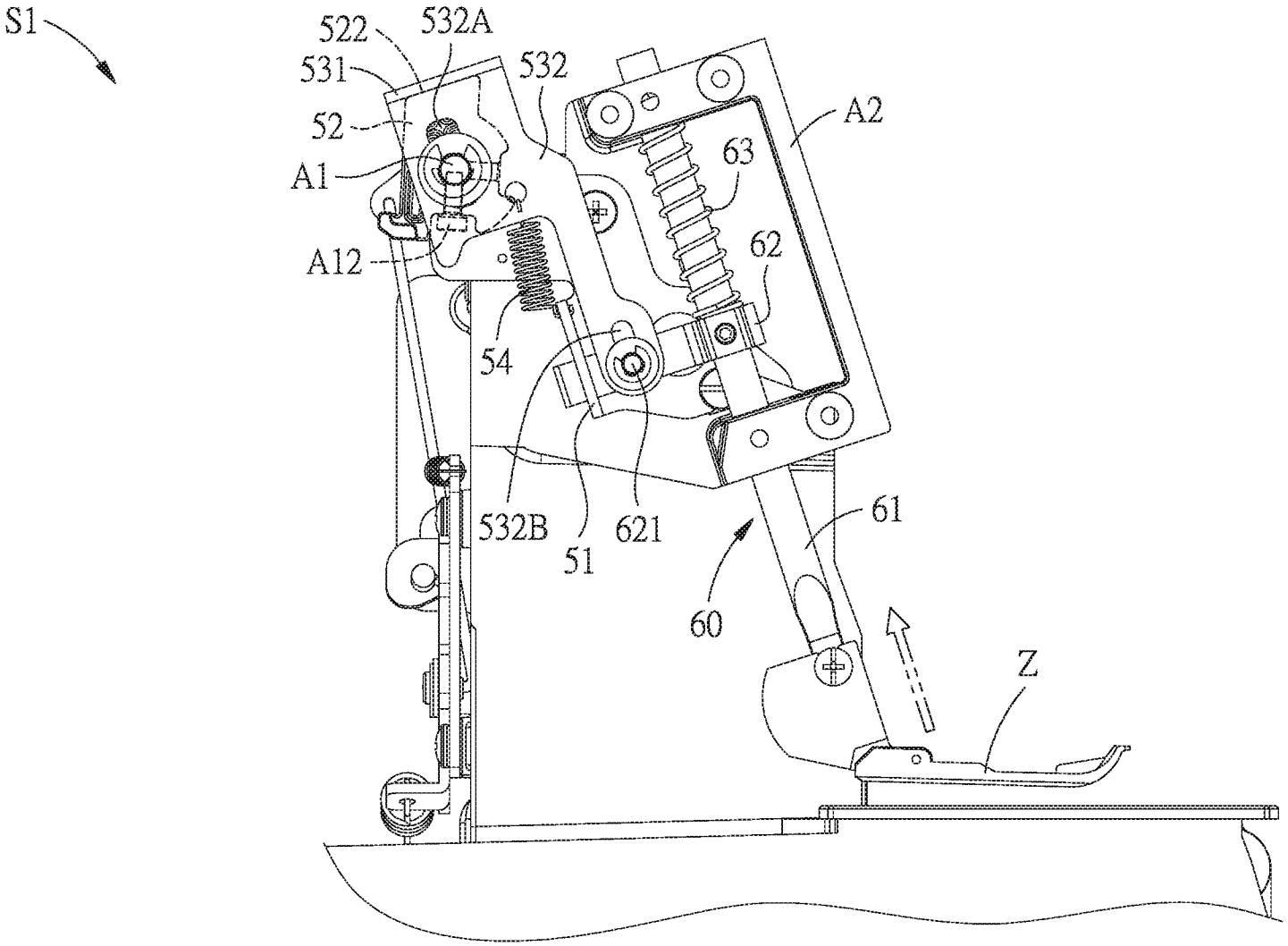
FIG. 9 shows the lifted up state of the knee operated lifting mechanism for a presser foot of a sewing machine in accordance with the present invention.
Figure 10:
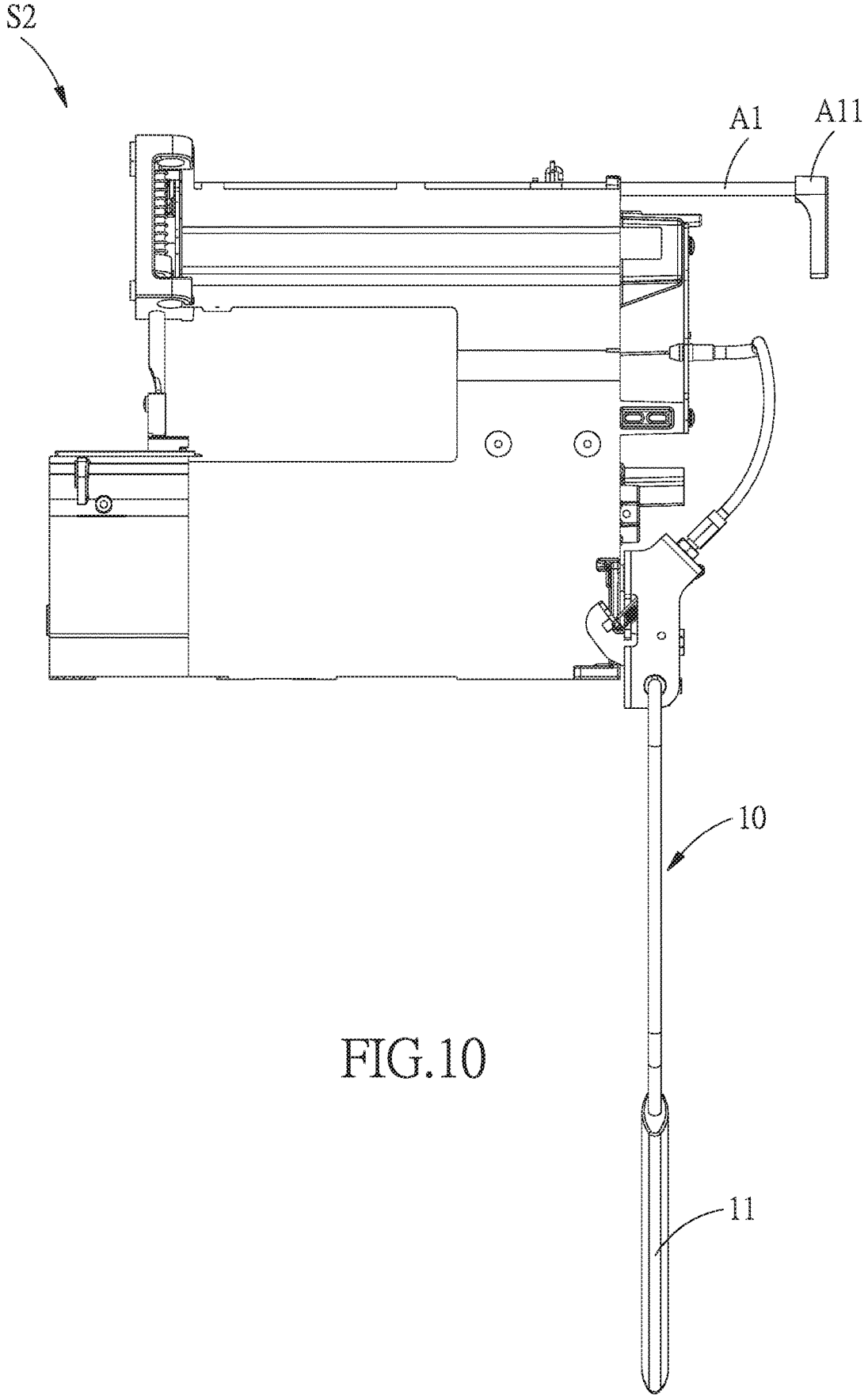
FIG. 10 is an illustrative view showing the pushed down state of the knee operated lifting mechanism for a presser foot of a sewing machine in accordance with the present invention.

The presser-foot shaft A1 is located higher than the rotary member 42 in the height direction K, and has a first end provided with a handle A11 for an user to grip and rotate. A second end of the presser-foot shaft A1 is provided with at least one fixing bolt A12 (as shown in FIG. 9).

Figure 7:
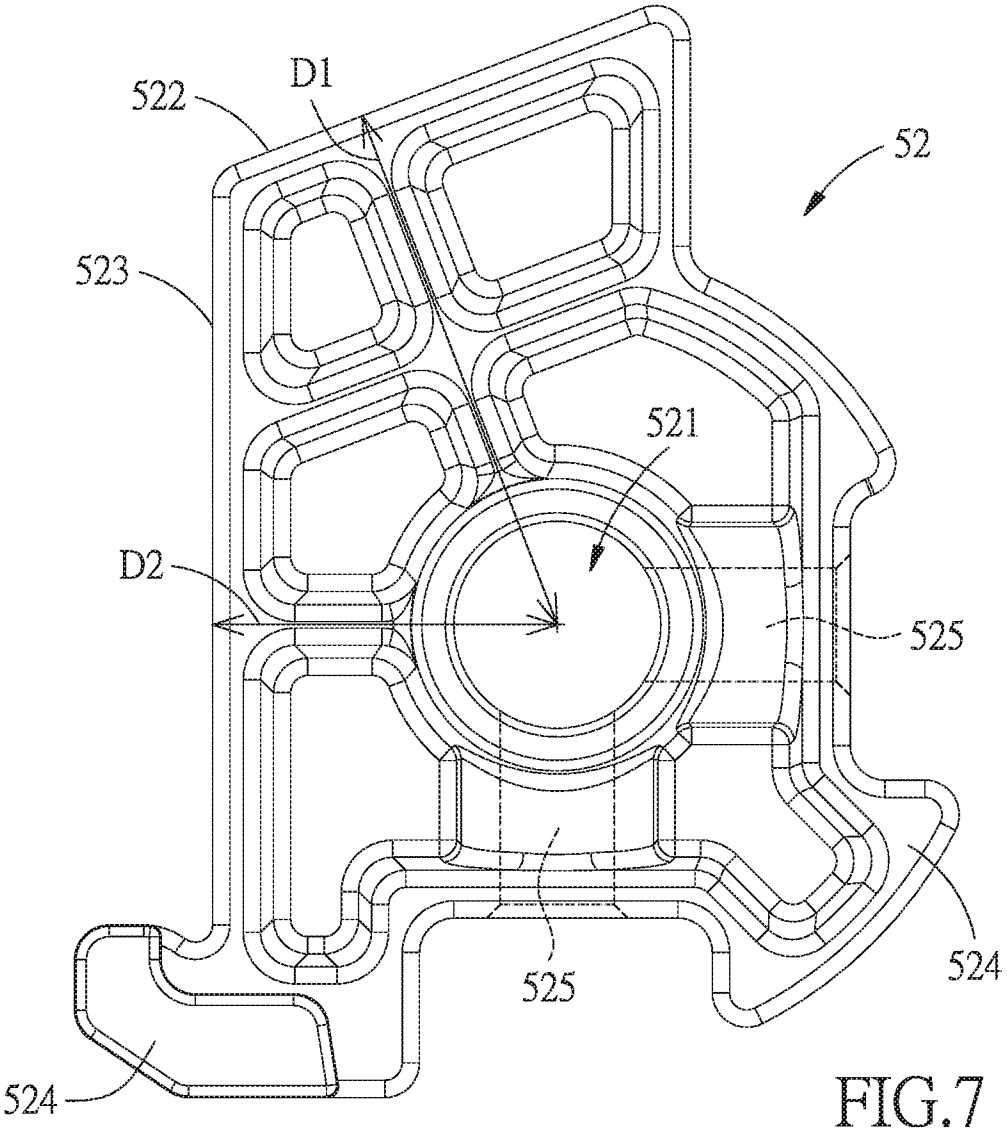
FIG. 7 is a plan view of a pivoting member of the knee operated lifting mechanism for a presser foot of a sewing machine in accordance with the present invention.
Figure 8:
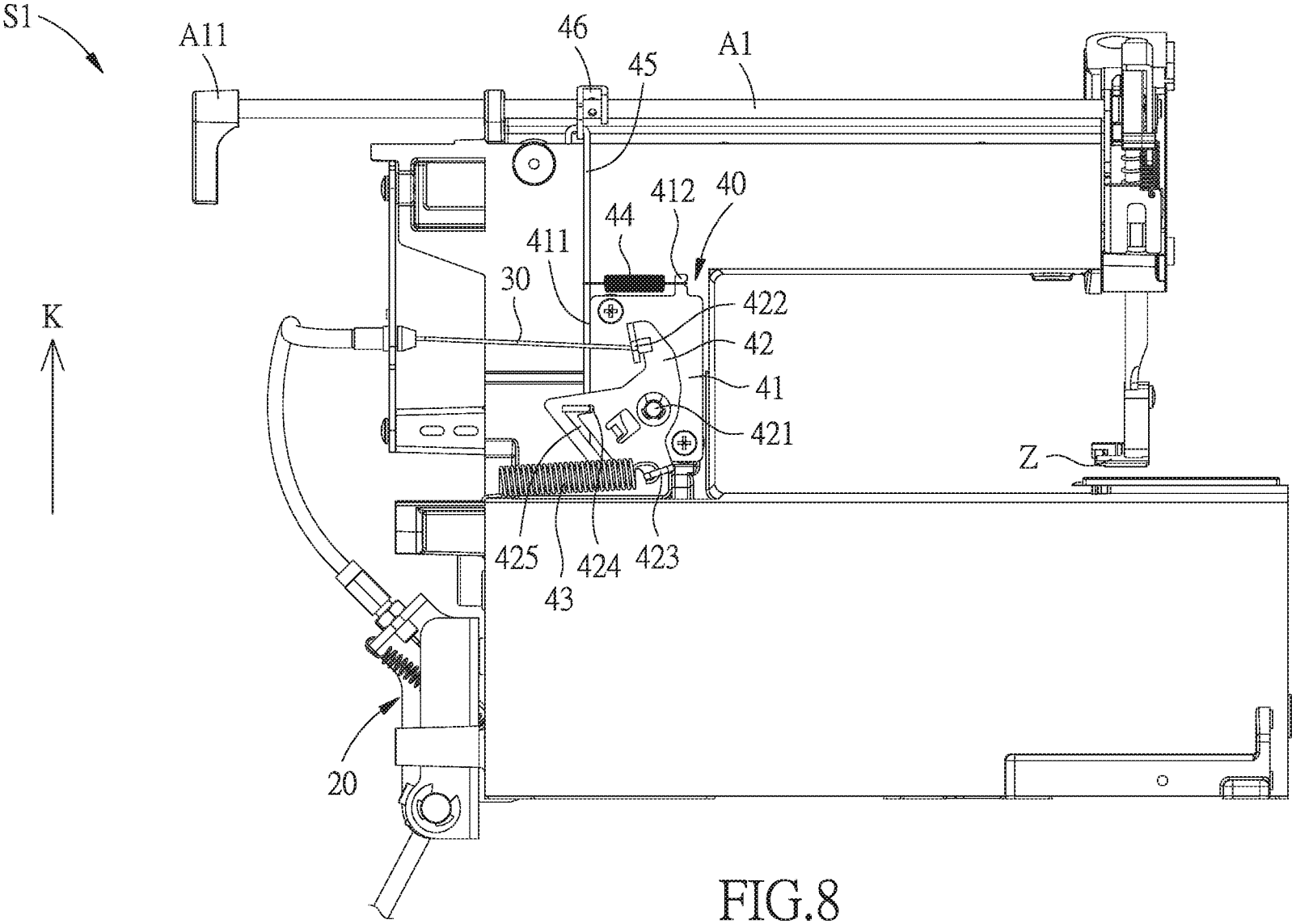
FIG. 8 shows the lifted up state of the knee operated lifting mechanism for a presser foot of a sewing machine in accordance with the present invention.

The lifting device 50 includes a positioning member 51, a pivoting member 52 and a lifting member 53. The positioning member 51 is fixed to the one side of the base A, inserted to the second end of the presser-foot shaft A1, and includes a restricting slot 511. The pivoting member 52 is inserted on the presser-foot shaft A1, located between the positioning member 51 and the lifting member 53, and includes a pivot hole 521 for insertion of the presser-foot shaft A1, and further includes a first abutting surface 522 and a second abutting surface 523 connected to the first abutting surface 522. A distance from a center of the pivot hole 521 to the first abutting surface 522 is defined as a first distance D1, a distance from the center of the pivot hole 521 to the second abutting surface 523 is defined as a second distance D2, and D1 is larger than D2 (as shown in FIG. 7). The pivoting member 52 further includes two restricting feet 524, one of the restricting feet 524 is connected to the second abutting surface 523, and between the two restricting feet 524 is defined a penetrating hole 525 in communication with the pivot hole 521. Between another of the restricting feet 524 and the first abutting surface 522 is also defined a penetrating hole 525 in communication with the pivot hole 521. The fixing bolt A12 is inserted through the penetrating hole 525 to ensure that the pivoting member 52 can rotate synchronously with the presser-foot shaft A1. The lifting member 53 includes an abutting portion 531 and a drive portion 532 connected and perpendicular to the abutting portion 531. When the presser foot is in the presser foot lifted up state S1, the abutting portion 531 is abutted against the second abutting surface 523. The drive portion 532 includes a first positioning hole 532A and a second positioning hole 532B which extend in the height direction K. The second end of the presser-foot shaft A1 is inserted in the first positioning hole 532A. A fourth elastic member 54 has one end fixed to the positioning member 51 and another end fixed to the lifting member 53, so that the abutting portion 531 of the lifting member 53 can be pressed against the first abutting surface 522 or the second abutting surface 523.

The cloth presser 60 includes a presser rod 61, a positioning rod 62 and an elastic member 63. The presser rod 61 is inserted in a support rack A2 of the body A, the positioning rod 62 has a first end fixed to the presser rod 61, and the elastic member 63 is sleeved onto the presser rod 61 and has two ends pressed against the support rack A2 and the positioning rod 62, respectively. A second end of the positioning rod 62 is inserted in and movable along the restricting slot 511. The positioning rod 62 includes a positioning pin 621 inserted in the second positioning hole 532B and abutted against one end of the second positioning hole 532B. The presser rod 61 has one end provided for mounting of the presser foot Z.

What mentioned above are the structures of the knee operated lifting mechanism for the presser foot Z of a sewing machine in accordance with the present invention, for the operation and function of the invention are explained as follows.

Referring to FIGS. 1-9 first, when a user's knee pushes the knee pushing plate 11 outwards, the knee operated lifting mechanism for the presser foot of the invention is in the presser foot lifted up state S1, meanwhile, the rod 12 also rotates synchronously to rotate the linkage piece 22 and pull one end of the cable 30, and then another end of the cable 30 pulls the rotary member 42 to rotate. Then, the end of the drive shaft 45 inserted in the slide slot 424 is moved to the second terminal edge 424B, as a result, the drive shaft 45 is moved downward to pull the hanging portion 46 to rotate the presser-foot shaft A1. At this moment, the pivoting member 52 is driven to rotate until the first abutting surface 522 is stopped against the abutting portion 531, so that the lifting member 53 is lifted up. Meanwhile, the positioning pin 621 inserted in the second positioning hole 532B is lifted up by the lower edge of the second positioning hole 532B, and the positioning rod 62 and the presser rod 61 are also synchronously lifted up, thus lifting up the presser foot Z.

When in the presser foot pushed down state S2, as shown in FIGS. 10-13, and when the user's knee moves away from the knee pushing plate 11, the linkage piece 22 is rotated back to its original position by the elastic force of the first elastic member 23, and release the cable 30. Then another end of the cable 30 pulls the rotary member 42 to rotate, the end of the drive shaft 45 inserted in the slide slot 424 is moved to the first terminal edge 424A, as a result, the drive shaft 45 is moved upward to push the hanging portion 46 to rotate the presser-foot shaft A1. At this moment, the pivoting member 52 is driven to rotate until the second abutting surface 523 is stopped against the abutting portion 531, so that the lifting member 53 is lowered down. Meanwhile, the positioning pin 621 inserted in the second positioning hole 532B is also lowered down, and the positioning rod 62 and the presser rod 61 are also synchronously moved downward, and thus the presser foot Z is lowered down.

Figure 14:
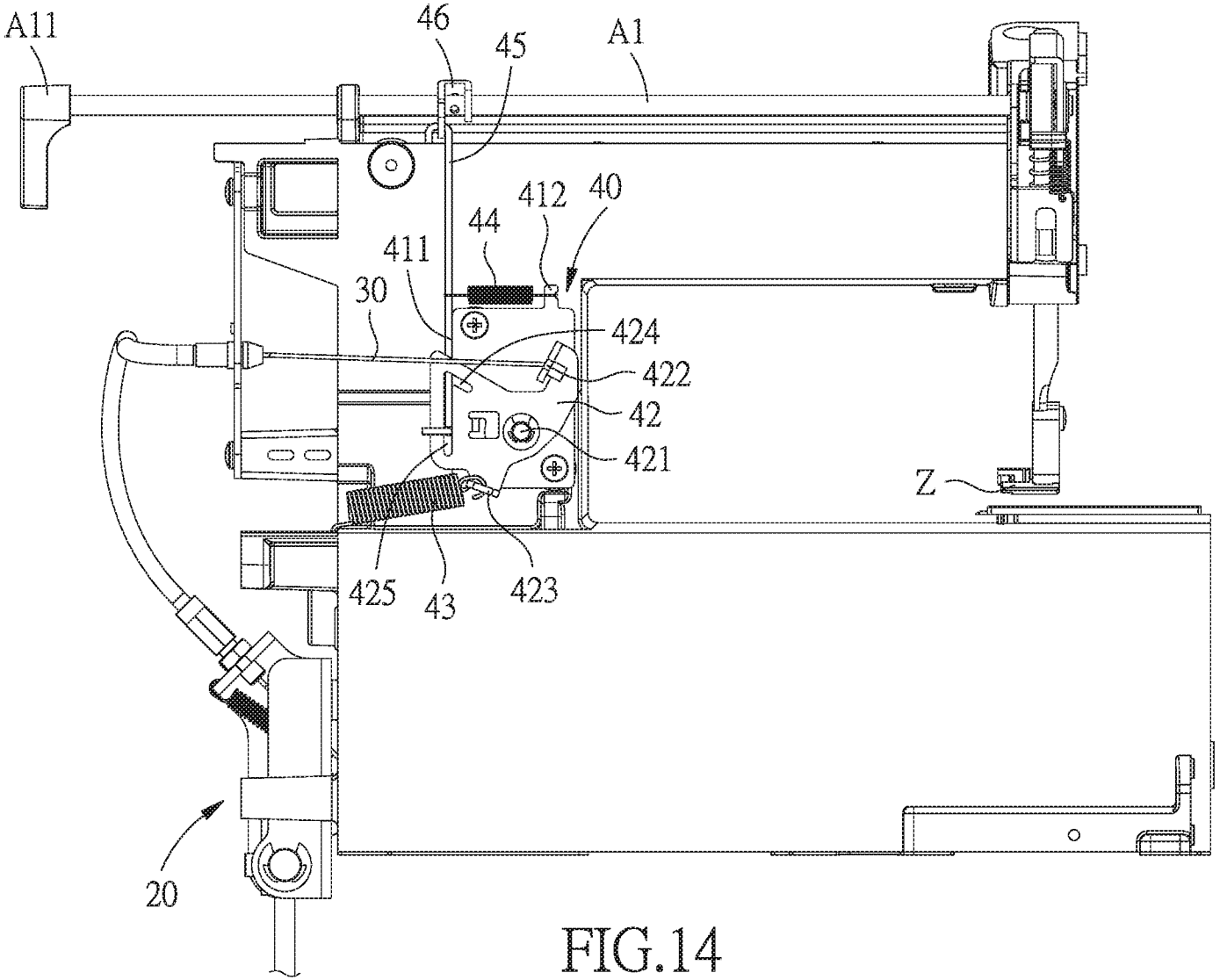
FIG. 14 is an illustrative view showing that the knee operated lifting mechanism for a presser foot of a sewing machine in accordance with the present invention is controlled by a handle.

It is to be noted that, as shown in FIG. 14, when the knee operated lifting mechanism for the presser foot of the invention is in the presser foot pushed down state S2, namely, at the end of use, the user only needs to rotate the presser-foot shaft A1 by pulling the handle A11, so as to push the drive shaft 45 downward, and the end of the drive shaft 45 located in the slide slot 424 will fall into the idle slot 425, so that the knee pushing plate 11 cannot control the up and down motion of the presser foot Z anymore. Meanwhile, the presser foot Z also synchronously moves upward to provide a protection function. When the user wants to use again, he/she only needs to push the drive shaft 45 up into the slide slot 424 by pulling the handle A11 again, so that the knee pushing plate 11 can control the up and down motion of the presser foot Z again.

By such arrangements, the knee operated lifting mechanism for the presser foot of the invention is capable of pulling the cable 30 by pushing the knee pushing plate 11, then the cable 30 pulls the rotary member 42 to rotate. Meanwhile, the drive shaft 45 is pushed to move upward or downward to drive the presser-foot shaft A1 to rotate by different angles, which consequently causes the presser foot Z to move upward or downward. Motion is transmitted through the cable 30 during the motion transmission process, which makes the invention easier to assemble and simplifies the structure of the invention.

Besides, in another embodiment, the knee operated lifting mechanism for the presser foot of the invention employs the knee pushing plate 11 to drive the presser-foot shaft A1 to rotate by different angles, and then the pivoting member 52 is driven to rotate to make the first abutting surface 522 or the second abutting surface 523 stops against the lifting member 53, so that the lifting member 53 is lifted up or lowered down to cause the presser rod 61 on which the presser foot Z is mounted to move upward or downward, thus simplifying the structure of the invention.

While we have shown and described various embodiments in accordance with the present invention, it is clear to those skilled in the art that further embodiments may be made without departing from the scope of the present invention.

What is claimed is:

1. A knee operated lifting mechanism for a presser foot of a sewing machine being fixed on a body of the sewing machine, the body being provided with a presser-foot shaft, the knee operated lifting mechanism is drivingly connected to the presser-foot shaft, so as to consequently drive the presser foot to move up and down, the knee operated lifting mechanism comprising:

a knee pushing device including a knee pushing plate to be operated by a user;

a cable drivingly connected to the knee pushing plate;

a rotary member pivotally mounted on the body of the sewing machine and including a cable fixing portion and a slide slot, wherein the cable is fixed to the cable fixing portion; and a drive shaft with one end inserted in the slide slot and another end drivingly connected to the presser-foot shaft;

pushing the knee pushing plate controls the cable to pull the rotary member to rotate, then the drive shaft drives the presser-foot shaft to rotate, consequently, the presser foot is driven to move upward, and when the rotary member rotates back to its original position, the drive shaft drives the presser-foot shaft to rotate back to original position, and thus the presser foot is pushed downward.

2. The knee operated lifting mechanism as claimed in claim 1, wherein the knee operated lifting mechanism includes a presser foot lifted up state in which the presser foot is lifted up and a presser foot pushed down state in which the presser foot is pushed down, the drive shaft extends in a height direction, the slide slot includes a first terminal edge and a second terminal edge, when in the presser foot lifted up state, the first terminal edge pushes the one end of the drive shaft to move downwards, and when in the presser foot pushed down state, the second terminal edge pushes the one end of the drive shaft to move upwards.

3. The knee operated lifting mechanism as claimed in claim 2, wherein the rotary member further includes an idle slot with one end connected to the first terminal edge, and the one end of the drive shaft is able to slide within the slide slot and the idle slot.

4. The knee operated lifting mechanism as claimed in claim 3 further comprising a lifting device which includes a pivoting member inserted on the presser-foot shaft, and a lifting member, the presser-foot shaft is inserted in and drives the pivoting member to rotate, the pivoting member includes a pivot hole for insertion of the presser-foot shaft, a first abutting surface and a second abutting surface, a distance from a center of the pivot hole to the first abutting surface is defined as a first distance, a distance from the center of the pivot hole to the second abutting surface is defined as a second distance, the first distance is larger than the second distance, so as to allow the presser foot to move upward, the lifting member includes an abutting portion and a drive portion connected to the abutting portion, the drive portion drives the presser foot to move, when the presser foot moves upward, the abutting portion is abutted against the first abutting surface;

by such arrangements, the presser-foot shaft rotates the pivoting member to make the first abutting surface press against the abutting portion, and then the lifting member is caused to push the presser foot to move upward.

5. The knee operated lifting mechanism as claimed in claim 4, wherein the lifting device includes a positioning member, the pivoting member is located between the positioning member and the lifting member, the positioning member includes a restricting slot;

the drive portion includes a first positioning hole and a second positioning hole, the presser-foot shaft is inserted in the first positioning hole;

a fourth elastic member has one end fixed to the positioning member and another end fixed to the lifting member, so as to provide a force for pushing the abutting portion of the lifting member towards the first abutting surface or the second abutting surface;

a cloth presser includes a presser rod, a positioning rod and an elastic member, the presser rod is inserted in the body, the positioning rod has a first end fixed to the presser rod, the elastic member is sleeved onto the presser rod and has one end pressed against the positioning rod, a second end of the positioning rod is inserted in and movable along the restricting slot, the positioning rod includes a positioning pin inserted in the second positioning hole and abutted against one end of the second positioning hole, and the presser rod has one end provided for mounting of the presser foot.

6. The knee operated lifting mechanism as claimed in claim 2 further comprising a fixing member and a third elastic member, the fixing member is fixed to the body, and includes a lateral surface and a fixing portion, the rotary member is pivotally connected to the fixing member, the third elastic member has one end hooked to the fixing portion and another end to the drive shaft, so that the drive shaft is abutted against the lateral surface of the fixing member.

7. The knee operated lifting mechanism as claimed in claim 6 further comprising a lifting device which includes a pivoting member inserted on the presser-foot shaft, and a lifting member, the presser-foot shaft is inserted in and drives the pivoting member to rotate, the pivoting member includes a pivot hole for insertion of the presser-foot shaft, a first abutting surface and a second abutting surface, a distance from a center of the pivot hole to the first abutting surface is defined as a first distance, a distance from the center of the pivot hole to the second abutting surface is defined as a second distance, the first distance is larger than the second distance, so as to allow the presser foot to move upward, the lifting member includes an abutting portion and a drive portion connected to the abutting portion, the drive portion drives the presser foot to move, when the presser foot moves upward, the abutting portion is abutted against the first abutting surface;

by such arrangements, the presser-foot shaft rotates the pivoting member to make the first abutting surface press against the abutting portion, and then the lifting member is caused to push the presser foot to move upward.

8. The knee operated lifting mechanism as claimed in claim 7, wherein the lifting device includes a positioning member, the pivoting member is located between the positioning member and the lifting member, the positioning member includes a restricting slot;

the drive portion includes a first positioning hole and a second positioning hole, the presser-foot shaft is inserted in the first positioning hole;

a fourth elastic member has one end fixed to the positioning member and another end fixed to the lifting member, so as to provide a force for pushing the abutting portion of the lifting member towards the first abutting surface or the second abutting surface;

a cloth presser includes a presser rod, a positioning rod and an elastic member, the presser rod is inserted in the body, the positioning rod has a first end fixed to the presser rod, the elastic member is sleeved onto the presser rod and has one end pressed against the positioning rod, a second end of the positioning rod is inserted in and movable along the restricting slot, the positioning rod includes a positioning pin inserted in the second positioning hole and abutted against one end of the second positioning hole, and the presser rod has one end provided for mounting of the presser foot.

9. The knee operated lifting mechanism as claimed in claim 2 further comprising a lifting device which includes a pivoting member inserted on the presser-foot shaft, and a lifting member, the presser-foot shaft is inserted in and drives the pivoting member to rotate, the pivoting member includes a pivot hole for insertion of the presser-foot shaft, a first abutting surface and a second abutting surface, a distance from a center of the pivot hole to the first abutting surface is defined as a first distance, a distance from the center of the pivot hole to the second abutting surface is defined as a second distance, the first distance is larger than the second distance, so as to allow the presser foot to move upward, the lifting member includes an abutting portion and a drive portion connected to the abutting portion, the drive portion drives the presser foot to move, when the presser foot moves upward, the abutting portion is abutted against the first abutting surface;

by such arrangements, the presser-foot shaft rotates the pivoting member to make the first abutting surface press against the abutting portion, and then the lifting member is caused to push the presser foot to move upward.

10. The knee operated lifting mechanism as claimed in claim 9, wherein the lifting device includes a positioning member, the pivoting member is located between the positioning member and the lifting member, the positioning member includes a restricting slot;

the drive portion includes a first positioning hole and a second positioning hole, the presser-foot shaft is inserted in the first positioning hole;

a fourth elastic member has one end fixed to the positioning member and another end fixed to the lifting member, so as to provide a force for pushing the abutting portion of the lifting member towards the first abutting surface or the second abutting surface;

a cloth presser includes a presser rod, a positioning rod and an elastic member, the presser rod is inserted in the body, the positioning rod has a first end fixed to the presser rod, the elastic member is sleeved onto the presser rod and has one end pressed against the positioning rod, a second end of the positioning rod is inserted in and movable along the restricting slot, the positioning rod includes a positioning pin inserted in the second positioning hole and abutted against one end of the second positioning hole, and the presser rod has one end provided for mounting of the presser foot.

11. The knee operated lifting mechanism as claimed in claim 1, wherein the rotary member includes an elastic member fixing portion, and a second elastic member has one end hooked to the elastic member fixing portion and another end fixed to the body.

12. The knee operated lifting mechanism as claimed in claim 11 further comprising a lifting device which includes a pivoting member inserted on the presser-foot shaft, and a lifting member, the presser-foot shaft is inserted in and drives the pivoting member to rotate, the pivoting member includes a pivot hole for insertion of the presser-foot shaft, a first abutting surface and a second abutting surface, a distance from a center of the pivot hole to the first abutting surface is defined as a first distance, a distance from the center of the pivot hole to the second abutting surface is defined as a second distance, the first distance is larger than the second distance, so as to allow the presser foot to move upward, the lifting member includes an abutting portion and a drive portion connected to the abutting portion, the drive portion drives the presser foot to move, when the presser foot moves upward, the abutting portion is abutted against the first abutting surface;

by such arrangements, the presser-foot shaft rotates the pivoting member to make the first abutting surface press against the abutting portion, and then the lifting member is caused to push the presser foot to move upward.

13. The knee operated lifting mechanism as claimed in claim 1, wherein the knee pushing device includes a rod with one end fixed to the knee pushing plate;

a first cable drive mechanism includes a main body and a linkage piece, the main body includes: two lateral walls and a main wall connected between the two lateral walls, the main wall includes a hole, the linkage piece includes a first section, a second section and a third section which are connected in sequence to one another, the first section is connected to another end of the rod, the first section is located at one side of the main body and is pivotally connected to the main body, so that, when the rod rotates, the first section is driven to rotate with respect to the main body, the second section is inserted in the hole, the third section is located at another side of the main body, and includes a cable locking portion for fixing the cable.

14. The knee operated lifting mechanism as claimed in claim 13, wherein the hole is formed by a main hole and a restricting hole, the restricting hole is provided with a restricting wall, one of the lateral walls includes an extension portion, the second section includes a restricting surface facing toward the restricting wall, and the third section includes a hooking portion;

a first elastic member has one end fixed to the extension portion and another end fixed to the hooking portion, with an elastic force of the first elastic member, the third section is maintained in an inclined upward position to make the restricting surface abut against the restricting wall.

15. The knee operated lifting mechanism as claimed in claim 14 further comprising a lifting device which includes a pivoting member inserted on the presser-foot shaft, and a lifting member, the presser-foot shaft is inserted in and drives the pivoting member to rotate, the pivoting member includes a pivot hole for insertion of the presser-foot shaft, a first abutting surface and a second abutting surface, a distance from a center of the pivot hole to the first abutting surface is defined as a first distance, a distance from the center of the pivot hole to the second abutting surface is defined as a second distance, the first distance is larger than the second distance, so as to allow the presser foot to move upward, the lifting member includes an abutting portion and a drive portion connected to the abutting portion, the drive portion drives the presser foot to move, when the presser foot moves upward, the abutting portion is abutted against the first abutting surface;

by such arrangements, the presser-foot shaft rotates the pivoting member to make the first abutting surface press against the abutting portion, and then the lifting member is caused to push the presser foot to move upward.

16. The knee operated lifting mechanism as claimed in claim 13 further comprising a lifting device which includes a pivoting member inserted on the presser-foot shaft, and a lifting member, the presser-foot shaft is inserted in and drives the pivoting member to rotate, the pivoting member includes a pivot hole for insertion of the presser-foot shaft, a first abutting surface and a second abutting surface, a distance from a center of the pivot hole to the first abutting surface is defined as a first distance, a distance from the center of the pivot hole to the second abutting surface is defined as a second distance, the first distance is larger than the second distance, so as to allow the presser foot to move upward, the lifting member includes an abutting portion and a drive portion connected to the abutting portion, the drive portion drives the presser foot to move, when the presser foot moves upward, the abutting portion is abutted against the first abutting surface;

by such arrangements, the presser-foot shaft rotates the pivoting member to make the first abutting surface press against the abutting portion, and then the lifting member is caused to push the presser foot to move upward.

17. The knee operated lifting mechanism as claimed in claim 16, wherein the lifting device includes a positioning member, the pivoting member is located between the positioning member and the lifting member, the positioning member includes a restricting slot;

the drive portion includes a first positioning hole and a second positioning hole, the presser-foot shaft is inserted in the first positioning hole;

a fourth elastic member has one end fixed to the positioning member and another end fixed to the lifting member, so as to provide a force for pushing the abutting portion of the lifting member towards the first abutting surface or the second abutting surface;

a cloth presser includes a presser rod, a positioning rod and an elastic member, the presser rod is inserted in the body, the positioning rod has a first end fixed to the presser rod, the elastic member is sleeved onto the presser rod and has one end pressed against the positioning rod, a second end of the positioning rod is inserted in and movable along the restricting slot, the positioning rod includes a positioning pin inserted in the second positioning hole and abutted against one end of the second positioning hole, and the presser rod has one end provided for mounting of the presser foot.

18. The knee operated lifting mechanism as claimed in claim 1 further comprising a lifting device which includes a pivoting member inserted on the presser-foot shaft, and a lifting member, the presser-foot shaft is inserted in and drives the pivoting member to rotate, the pivoting member includes a pivot hole for insertion of the presser-foot shaft, a first abutting surface and a second abutting surface, a distance from a center of the pivot hole to the first abutting surface is defined as a first distance, a distance from the center of the pivot hole to the second abutting surface is defined as a second distance, the first distance is larger than the second distance, so as to allow the presser foot to move upward, the lifting member includes an abutting portion and a drive portion connected to the abutting portion, the drive portion drives the presser foot to move, when the presser foot moves upward, the abutting portion is abutted against the first abutting surface;

by such arrangements, the presser-foot shaft rotates the pivoting member to make the first abutting surface press against the abutting portion, and then the lifting member is caused to push the presser foot to move upward.

19. The knee operated lifting mechanism as claimed in claim 18, wherein the lifting device includes a positioning member, the pivoting member is located between the positioning member and the lifting member, the positioning member includes a restricting slot;

the drive portion includes a first positioning hole and a second positioning hole, the presser-foot shaft is inserted in the first positioning hole;

a fourth elastic member has one end fixed to the positioning member and another end fixed to the lifting member, so as to provide a force for pushing the abutting portion of the lifting member towards the first abutting surface or the second abutting surface;

a cloth presser includes a presser rod, a positioning rod and an elastic member, the presser rod is inserted in the body, the positioning rod has a first end fixed to the presser rod, the elastic member is sleeved onto the presser rod and has one end pressed against the positioning rod, a second end of the positioning rod is inserted in and movable along the restricting slot, the positioning rod includes a positioning pin inserted in the second positioning hole and abutted against one end of the second positioning hole, and the presser rod has one end provided for mounting of the presser foot.

20. A knee operated lifting mechanism for a presser foot of a sewing machine being fixed on a body of the sewing machine, the body being provided with a presser-foot shaft, the knee operated lifting mechanism is drivingly connected to the presser-foot shaft, so as to consequently drive the presser foot to move up and down, the knee operated lifting mechanism comprising:

a knee pushing device including a knee pushing plate to be operated by a user;

a cable drivingly connected to the knee pushing plate and the presser-foot shaft;

a lifting device includes a pivoting member inserted on the presser-foot shaft, and a lifting member, the presser-foot shaft is inserted in and drives the pivoting member to rotate, the pivoting member includes a pivot hole for insertion of the presser-foot shaft, a first abutting surface and a second abutting surface, a distance from a center of the pivot hole to the first abutting surface is defined as a first distance, a distance from the center of the pivot hole to the second abutting surface is defined as a second distance, the first distance is larger than the second distance, so as to allow the presser foot to move upward, the lifting member includes an abutting portion and a drive portion connected to the abutting portion, the drive portion drives the presser foot to move, when the presser foot moves upward, the abutting portion is abutted against the first abutting surface; by such arrangements, pushing the knee pushing plate controls the cable to pull the presser-foot shaft and the pivoting member to rotate to make the first abutting surface press against the abutting portion, and then the lifting member is caused to push the presser foot to move upward.

* * * * *